US009637991B2

(12) United States Patent
Eddison et al.

(10) Patent No.: US 9,637,991 B2
(45) Date of Patent: May 2, 2017

(54) RUNNING AND CEMENTING TUBING

(75) Inventors: Alan Martyn Eddison, Stonehaven (GB); Leslie Robertson, Altens (GB); Richard Alexander Innes, Altens (GB)

(73) Assignee: NOV DOWNHOLE EURASIA LIMITED, Stonehouse, Gloucestershire (GB)

( * ) Notice: Subject to any disclaimer, the term of this patent is extended or adjusted under 35 U.S.C. 154(b) by 0 days.

(21) Appl. No.: 12/775,153

(22) Filed: May 6, 2010

(65) Prior Publication Data

US 2010/0212900 A1 Aug. 26, 2010

Related U.S. Application Data

(63) Continuation of application No. 10/576,884, filed as application No. PCT/GB2004/004503 on Oct. 25, 2004, now abandoned.

(30) Foreign Application Priority Data

Oct. 23, 2003 (GB) ..... 0324744.2

(51) Int. Cl.
*E21B 28/00* (2006.01)
*E21B 31/113* (2006.01)
*E21B 31/00* (2006.01)

(52) U.S. Cl.
CPC ..... *E21B 31/113* (2013.01); *E21B 28/00* (2013.01); *E21B 31/005* (2013.01)

(58) Field of Classification Search
CPC ..... E21B 28/00; E21B 7/24; E21B 31/005; E21B 4/02; E21B 19/00; E21B 33/14
USPC ..... 166/177.6, 177.7, 380
See application file for complete search history.

(56) References Cited

U.S. PATENT DOCUMENTS

| | | | | |
|---|---|---|---|---|
| 2,743,083 | A * | 4/1956 | Zublin | E21B 7/24 173/73 |
| 2,746,721 | A | 5/1956 | Moore | |
| 2,780,438 | A | 2/1957 | Bielstein | |
| 3,152,642 | A | 10/1964 | Bodine | |
| 3,379,263 | A | 4/1968 | Bodine | |
| 3,557,875 | A | 1/1971 | Solum et al. | |
| 3,640,351 | A | 2/1972 | Coyne et al. | |
| 3,894,818 | A | 7/1975 | Tschirky | |
| 3,899,033 | A | 8/1975 | Van Huisen | |
| 3,933,209 | A | 1/1976 | Sweeney | |

(Continued)

FOREIGN PATENT DOCUMENTS

| | | |
|---|---|---|
| EP | 0 335 543 | 10/1989 |
| EP | 0 461 321 AI | 12/1991 |

(Continued)

OTHER PUBLICATIONS

Office Action from European Patent Application No. 04 791 579. 8-2315 mailed Jun. 8, 2009.

(Continued)

*Primary Examiner* — Elizabeth Gitlin
(74) *Attorney, Agent, or Firm* — Conley Rose, P.C.

(57) ABSTRACT

A method of running a bore-lining tubing string into a bore includes running a tubing string, typically a liner string, into a bore while agitating the string. The agitation may also take place while the tubing is being cemented in the bore. Pressure pulses may be applied to fluid in the bore, which fluid may be cement slurry.

40 Claims, 3 Drawing Sheets

(56) References Cited

U.S. PATENT DOCUMENTS

| | | | | |
|---|---|---|---|---|
| 3,941,196 | A | 3/1976 | Curington et al. | |
| 4,027,282 | A | 5/1977 | Jeter | |
| 4,058,163 | A * | 11/1977 | Yandell | 166/177.6 |
| 4,817,739 | A | 4/1989 | Jeter | |
| 4,819,745 | A | 4/1989 | Walter | |
| 4,830,122 | A | 5/1989 | Walter | |
| 4,890,682 | A | 1/1990 | Worrall et al. | |
| 4,953,595 | A | 9/1990 | Kotlyar | |
| 4,979,577 | A | 12/1990 | Walter | |
| 5,009,272 | A | 4/1991 | Walter | |
| 5,048,622 | A | 9/1991 | Ide | |
| 5,152,342 | A * | 10/1992 | Rankin et al. | 166/286 |
| 5,190,114 | A | 3/1993 | Walter | |
| 5,361,830 | A | 11/1994 | Wicks et al. | |
| 5,607,017 | A * | 3/1997 | Owens et al. | 166/288 |
| 5,662,180 | A | 9/1997 | Coffman et al. | |
| 6,009,948 | A * | 1/2000 | Flanders et al. | 166/301 |
| 6,053,261 | A | 4/2000 | Walter | |
| 6,279,670 | B1 | 8/2001 | Eddison et al. | |
| 6,338,390 | B1 * | 1/2002 | Tibbitts | 175/56 |
| 6,439,318 | B1 | 8/2002 | Eddison et al. | |
| 6,508,317 | B2 | 1/2003 | Eddison et al. | |
| 6,571,870 | B2 * | 6/2003 | Zheng | E21B 4/18 166/177.6 |
| 2002/0050359 | A1 * | 5/2002 | Eddison | 166/321 |
| 2002/0121378 | A1 * | 9/2002 | Zheng et al. | 166/381 |
| 2003/0168212 | A1 * | 9/2003 | Ivannikov et al. | 166/249 |
| 2004/0011522 | A1 * | 1/2004 | Ivannikov et al. | 166/177.6 |
| 2005/0178558 | A1 * | 8/2005 | Kolle et al. | 166/373 |
| 2005/0284624 | A1 * | 12/2005 | Libby et al. | 166/177.6 |

FOREIGN PATENT DOCUMENTS

| | | |
|---|---|---|
| GB | 2 059 481 | 4/1982 |
| GB | 2 343 465 A | 5/2000 |

OTHER PUBLICATIONS

International Search Report for PCT/GB2004/004503 completed Dec. 28, 2004.

Written Opinion of the International Searching Authority for PCT/GB2004/004503 issued by the European Patent Office.

Definition of "Tubing"; Society of Petroleum Engineers.www.SPE.org.

Office Action from U.S. Appl. No. 10/576,884 mailed Apr. 30, 2009.

Office Action from U.S. Appl. No. 10/576,884 mailed Nov. 6, 2009.

Office Action dated Aug. 10, 2011 for Canadian Application No. 2,543,423.

Nordic Patent Institute, Office Action and Search Report for Application No. 20062321, Sep. 30, 2014, 8 pages, Denmark.

* cited by examiner

RUNNING AND CEMENTING TUBING

CROSS-REFERENCE TO RELATED APPLICATIONS

This application is a continuation of prior U.S. application Ser. No. 10/576,884, filed Mar. 29, 2007, which was the National Stage filing under 35 U.S.C. 371 of International Application No. PCT/GB2004/004503, filed Oct. 25, 2004, which International Application was published by the International Bureau in English on May 12, 2005 and which International Application claims priority to United Kingdom Application No. GB 0324744.2, filed on Oct. 23, 2003, all of which are hereby incorporated by reference herein in their entirety.

FIELD OF THE INVENTION

This invention relates to apparatus and methods for use in running tubing strings into drilled bores. Aspects of the invention also relate to cementing tubing in drilled bores.

BACKGROUND OF THE INVENTION

Bores drilled to access subterranean formations, and in particular hydrocarbon-bearing formations, are typically lined with metallic tubing, known as casing or liner. After the tubing is run into the bore, the annulus between the tubing and the surrounding bore wall is filled with cement slurry which sets to seal the annulus to prevent, for example, flow of fluid through the annulus from a high pressure formation intersected by the bore into a lower pressure formation intersected by another portion of the bore.

Casing and liner tend to be run into bores as strings of conjoined tubing sections, which strings may be up to several thousand meters long. The outer diameter of the strings will be only slightly less than the bore inner diameter and thus, particularly in extended reach and highly deviated bores, there may be considerable friction between the string and the bore tending to resist movement of the string through the bore. Also, deposits of loose material in the bore, ledges and doglegs may all serve to hinder an attempt to run a tubing string into a bore.

The end of the casing or liner string may be provided with a shoe provided with cutting or reaming elements which serve, through axial or rotational movement of the string, to dislodge, rasp or cut through bore obstructions. However, it may prove difficult to apply torque from surface to rotate such a shoe, as the connectors between adjacent sections of the string are generally not capable of withstanding any significant torque.

As noted above, once the tubing string is in place in the bore cement slurry is run down through the tubing string and into the annulus. This is achieved by pumping a slug of cement slurry of appropriate volume from surface to the leading end of the tubing, the cement slurry being isolated from other fluid in the well by appropriate leading and trailing darts or plugs. To achieve an effective cement seal between the tubing and the bore wall it is important that the fluid and any other deposits in the annulus are substantially completely displaced by the cement. This may be facilitated by rotating the string as the cement is pumped into the annulus, however as noted above it may be difficult to apply the torque necessary to rotate the string from surface, due to the frictional forces acting between the string and the bore wall.

It is among the objectives of embodiments of the invention to facilitate running in of casing and liner strings and also to facilitate cementation of such strings and thus obviate or mitigate a number of the abovementioned difficulties.

BRIEF SUMMARY OF THE INVENTION

According to a first aspect of the present invention there is provided a method of running a bore-lining tubing string into a bore, the method comprising running a tubing string into a bore while agitating the string to reduce the friction between the string and the bore wall.

Other aspects of the invention relate to apparatus for use in agitating a bore-lining tubing string.

The agitation or movement of the string as it is run into the bore has been found to facilitate the translation of the string into the bore, and is particularly useful in extended reach or highly deviated wells, and in running in the last string of bore-lining tubing into a bore. This may be due in part to the avoidance or minimising of static friction, to the relative movement induced between the string and the bore wall by the agitation. Also, the movement of the string may also serve to prevent or minimise gellation of fluid in the well which is in contact with the string and to fluidise sediments lying on the low side of deviated bores. In certain aspects of the invention fluid pressure pulses may be applied to the fluid in the well, which fluid may be inside or surrounding the string, and the pressure pulses, which may be applied in addition to or separately of the agitation, may also serve to prevent or minimise gellation of fluid in the well.

The tubing string may be translated solely axially, or may also be rotated as it is advanced into the bore. In both cases the agitation of the string has been found to reduce the drag experienced by the string.

In some cases, the string may be provided with a drill bit, reaming shoe or other cutting structure tool at its leading end, primarily to remove or displace bore obstructions which would otherwise impede the progress of the tubing string through the bore. The rotation of the drill bit may be provided by means of a downhole motor or by rotation from surface. As noted above, agitation of the string facilitates axial and rotational movement of the string in the bore and also allows for more effective transfer of weight to the drill bit: testing has demonstrated that, without agitation, typically only 10% of the weight applied to a tubing string at surface is transferred to the string nose, whereas with appropriate agitation 90% of the applied weight may be available at the nose, providing for far more effective cutting or reaming of bore obstructions.

Preferably the string is agitated by provision of an agitator in the string, and most preferably by provision of an agitator towards a leading end of the string. Alternatively, or in addition, one or more agitators may be provided at other locations in the string.

Preferably, the agitator is fluid actuated, and in particular may be actuated by fluid which is pumped through the tubing string. The actuating fluid may be conventional drilling fluid or "mud" or may be cement slurry or treating fluid. In a preferred embodiment the agitator is adapted to be actuated by both drilling fluid and cement slurry. Preferably, the fluid acts on a downhole motor, most preferably a positive displacement motor. This offers the advantage that the speed of the motor, and thus the rate of agitation, may be controlled by varying the fluid flow rate. Thus, the agitation frequency may be selected to suit local conditions and parameters, for example to match or to avoid a natural frequency of the string assembly.

Preferably, agitation is provided by means of an arrangement such as described in applicant's U.S. Pat. No. 6,508,317, the disclosure of which is incorporated herein by reference. The preferred agitator form includes a valve element that is movable to vary the dimension of a fluid passage. Preferably, the fluid passage dimension controls flow of fluid through the string, or at least a portion of the string, which fluid may be circulated down through the string and then up through the annulus between the string and the bore wall. Ideally, the fluid passage is never completely closed; rather the passage flow area is varied between a larger open area and a smaller open area, and most preferably includes a flow passage portion that remains open. The preferred agitator form provides positive pressure pulses in the fluid above the valve and negative pressure pulses in the fluid below the valve, that is the pressure in the fluid rises above the valve and falls below the valve as the flow passage area is restricted. Pressure pulses, and in particular positive pressure pulses, may act on a shock tool or the like which is arranged to axially extend and contract in response to the pressure pulses. The shock tool may be provided at any appropriate location in the tubing string, and may be above or below the agitator, but is preferably located directly above the agitator. In other embodiments the shock tool may be omitted.

Preferably, the agitator comprises a driven valve element. Thus the valve element is moved positively to vary the flow passage area. The valve element may be driven by any appropriate means but is preferably coupled to the rotor of a fluid driven motor, most preferably the rotor of a positive displacement motor. The rotor may provide rotational, transverse or axial movement and, in a preferred embodiment, as described in U.S. Pat. No. 6,508,317, the rotor is of a Moineau principle motor and is directly coupled to the valve member and provides both rotational and transverse movement to the valve member. As noted above, the frequency of pulses and thus of string agitation provided by a positive displacement motor-driven valve element is directly proportional to the fluid flow rate through the motor, and in addition in the preferred agitator form the pulse amplitude may also be controlled in this manner.

Preferably, the method further comprises cementing the tubing string in the bore while operating the agitator.

In preferred embodiments, the operation of the agitator will thus continue to agitate the tubing string and will also apply pressure pulses to the cement as it flows into and through the annulus. The agitation of the string will facilitate movement or manipulation of the tubing string. This movement is believed to facilitate displacement of fluid and other deposits from the annulus and ensure uniform distribution of the cement through and around the annulus. In other embodiments the movement of the tubing string induced by the agitation of the string may be sufficient to provide a similar effect. It is also believed that the application of pressure pulses to the cement, preferably negative pressure pulses in contrast to the positive pressure pulses experienced above the agitator, and the pulsed advancement of the cement slurry through the annulus, will also assist in displacing material from the annulus ahead of the cement and in breaking up or dislodging any deposits in the annulus. It is also believed that the pressure pulses assist in maintaining the cement in a fluid state before setting commences and thus facilitate flow of the cement into and through the annulus.

The preferred form of agitator has, surprisingly, been found to operate well with cement slurry as the actuating fluid and cement has been found to pass through the agitator without difficulty. One known difficulty experienced in handling cement slurry is known as flash setting, which typically occurs when cement slurry encounters a restriction and the particulates in the slurry bridge the restriction and then pack off and solidify. This can take place in a very short time span, and without warning, and is difficult if not impossible to remedy. Without wishing to be bound by theory it is believed that the preferred agitator form avoids this difficulty by one or more of the provision of a flow path which is never completely closed, the provision of a valve member which is positively driven by a motor, and the provision of a valve member which is moved transversely as well as rotated and thus prevents build up of particulates at the valve. However, it may still be preferred to provide for cement bypass above the agitator, such that in the event of a difficulty with the agitator the cement slurry may pass directly into the annulus, without having to pass through the agitator.

In certain embodiments the agitator may be adapted to permit continued operation after the annulus has been filled with cement, such that agitation of the string may be continued while the cement cures. This may be achieved by providing a bypass path such that fluid may be passed through the agitator following the cement, but the fluid is not directed into the annulus.

The ability to vary one or more of the agitation frequency and the amplitude of the pressure pulses allows the agitator to be driven at a rate suitable for cementing, which may be different from the rate best suited to running the tubing string into the bore.

The apparatus of the various aspects of the invention may be left in the bore following cementation. In this case, the apparatus may be adapted to be drillable, such that it is possible to drill the bore beyond the end of the tubing string. In other cases the apparatus may be adapted to be soluble or part soluble such that by passing an appropriate liquid into the bore it is possible to dissolve or weaken the apparatus such that it may be removed from the bore. In other aspects of the invention the apparatus may be adapted to be retrievable, for example by running the apparatus on a separate string or by releasably mounting the apparatus in the tubing string.

It will be apparent to those of skill in the art that many of the above features have utility separately of the first aspect of the invention, and these features may form separate aspects of the invention.

BRIEF DESCRIPTION OF THE SEVERAL VIEWS OF THE DRAWING(S)

These and other aspects of the present invention will now be described, by way of example, with reference to the accompanying drawings, in which.

DETAILED DESCRIPTION OF THE INVENTION

Figure 1:
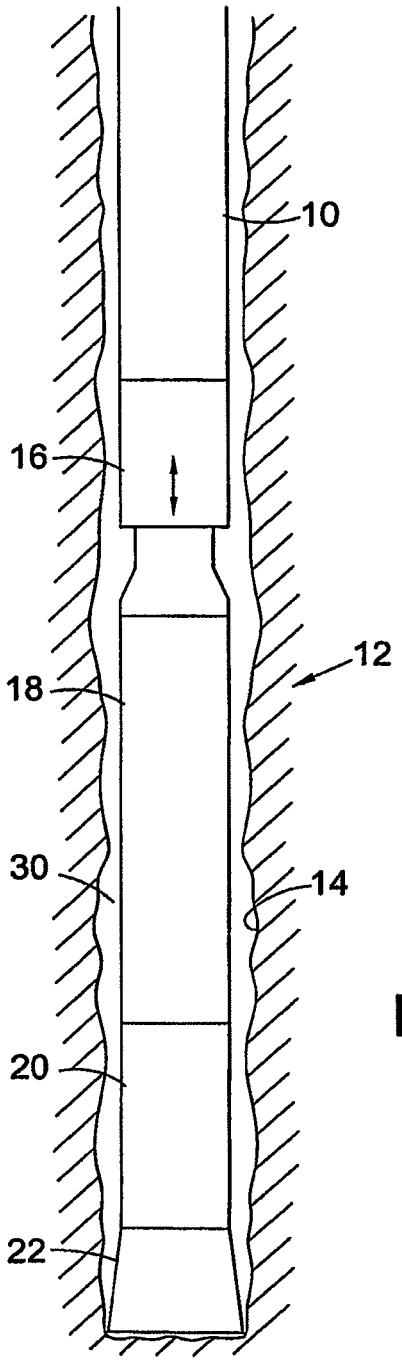
FIG. 1 is a schematic illustration of a string of bore-lining tubing incorporating apparatus in accordance with an embodiment of the present invention.

Reference is first made to FIG. 1 of the drawings, which illustrates the leading end of a string of bore-lining tubing 10 incorporating apparatus 12 in accordance with an embodiment of the present invention. In particular, the tubing is in the form of liner 10 intended to form the last lined section of a drilled bore 14 which has been drilled from surface to intersect a hydrocarbon-bearing formation. In this embodiment the liner has a solid wall, but other embodiments of the invention may involve use of slotted or otherwise perforated tubing.

The apparatus 12 comprises a shock sub 16, an agitator 18, a downhole motor 20 and a drill bit 22 and, as will be described, is used to facilitate running the liner string 10 into the bore 14 and then cementing the liner string 10 in the bore.

The drill bit 22 and downhole motor 20 are substantially conventional and are used in this embodiment to clear obstructions from the bore 14 as the string 10 is advanced through the bore. The motor is driven by drilling fluid which is pumped through the string 10 from surface, the fluid passing through jetting nozzles in the bit and then passing back to surface through the annulus 30 between the string 10 and the bore wall.

Figure 2:
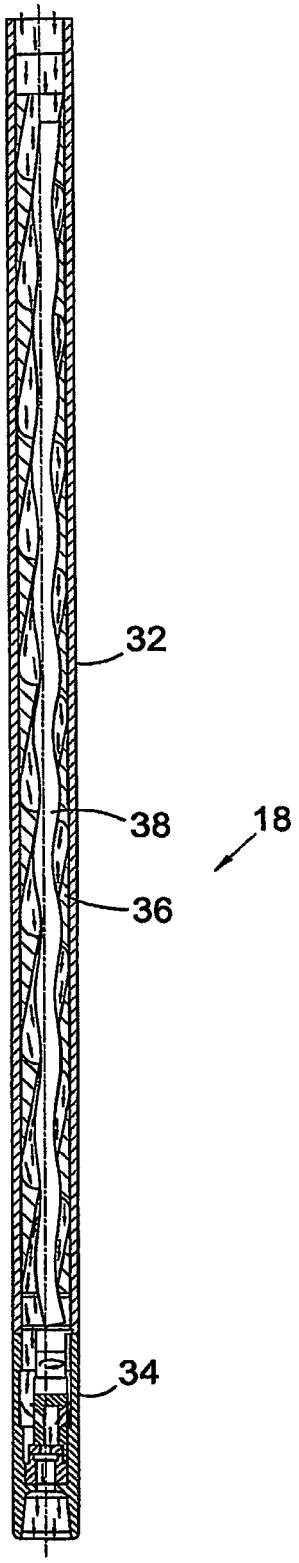
FIG. 2 is a sectional illustration of an agitator assembly of the apparatus of FIG. 1.
Figure 3:
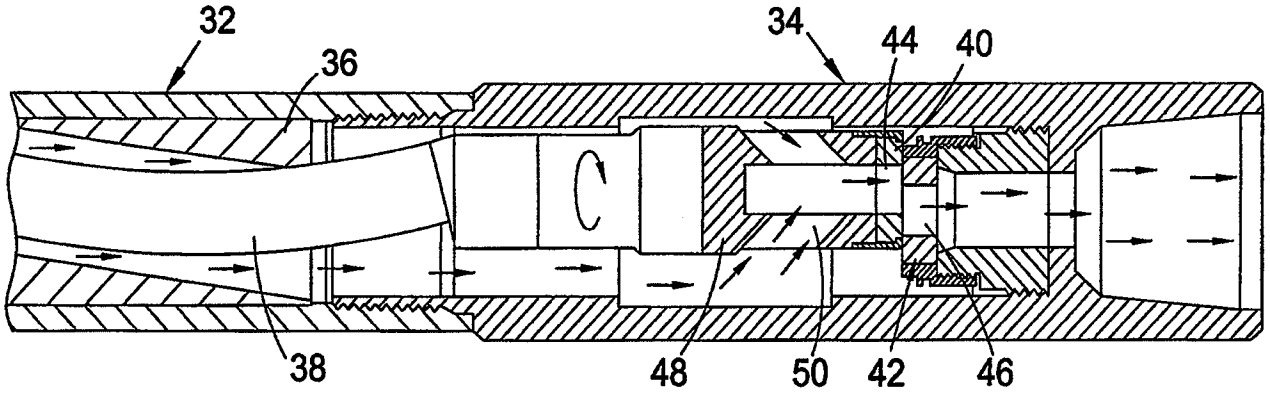
FIG. 3 is an enlarged sectional illustration of part of the agitator assembly of FIG. 2.

The agitator 18, as shown in greater detail in FIGS. 2 and 3 of the drawings, includes an elongate tubular body having an upper motor section 32 and a lower valve section 34. The motor section 32 accommodates a Moineau principle motor having a two lobe elastomeric stator 36 and a single lobe rotor 38. The valve section 34 accommodates first and second valve plates 40, 42, each defining a flow port 44, 46. The first valve plate 40 is directly mounted on the lower end of the rotor 38 via a ported connector 48 defining flow passages 50 which provide fluid communication between the variable geometry annulus defined between the stator 36 and the rotor 38 and the flow port 44. The second valve plate 42 is mounted on the valve section body 34 directly below the first valve plate 40 such that the respective flow ports 44, 46 coincide. As the rotor 38 rotates, due to fluid being pumped down through the motor section 32, the rotor 38 oscillates from side-to-side and this movement is transferred directly to the valve plate 40 to provide a cyclic variation in the flow area defined by the flow ports 44, 46.

The fluctuating fluid flow rate and fluid pressure pulses produced by the operation of the valve are, in this embodiment, used to operate the shock sub 16 positioned above the agitator 18. The shock sub 16 tends to extend in response to the positive pressure pulses it experiences, and tends to retract between the pulses. Furthermore, the pressure pulses are also transmitted upwardly through the string 10. The action of the shock sub 16 and the pressure pulses agitate the string 10 in the bore 14, facilitating translation of the string 10 through the bore 14. The operation of the shock sub 16 and the pressure pulses acting in the drilling fluid below the agitator 18 also provide a hammer drill effect at the bit 22. Furthermore, it has been found that the agitation of the string 10 facilitates transfer of weight from surface to the bit 22, allowing the bit 22 to operate far more effectively.

Once the string 10 has been translated to the bottom of the bore 14, a slug of cement slurry is pumped down through the string 10, and then down through the apparatus 12. The slug of cement is isolated from other fluids by appropriate darts or plugs, the leading plug or dart incorporating a burst disc which bursts when the dart encounters the upper end of the apparatus 12, to allow the cement slurry to be pumped through the apparatus 12, out of the bit 22 and into the annulus 30. The agitator 18 is actuated by the flow of cement slurry such that the string 10 continues to be agitated by the passage of the slurry therethrough. This agitation provides a number of advantages. Firstly, the agitation facilitates manipulation of the string 10 from surface, for example rotation of the string, which may be utilised to improve the distribution of cement through and around the annulus 30. The agitation also assists in maintaining the drilling fluid in the annulus 30 in a fluid state: some drilling fluids are formulated to gel if left undisturbed, and would be more difficult to displace from the annulus 30 if not maintained in a fluid state by the movement of the string 10. The agitation also fluidises deposits of drill cuttings and the like lying in the annulus, and thus facilitates displacement of the drill cuttings both during running in of the string 10 and during cementation.

The operation of the agitator 18 also creates pressure pulses in the cement slurry passing up through the annulus 30, which pulses are also believed to assist in displacing drilling fluid and any other deposits from the annulus 30.

The rate at which the cement slurry is pumped may be varied to provide a desired frequency and amplitude of agitation, selected to enhance the provision of an effective cement seal around the string.

The configuration of the agitator 18 is such that blockages within the agitator are unlikely to occur, however if desired a bypass facility may be provided above the apparatus 12, such that the cement slurry may be directed into the annulus 30 without having to pass through the apparatus 12.

In this embodiment agitation of the string 10 will cease when the annulus 30 is filled with the cement slurry. However, in other embodiments a fluid bypass or the like may be provided to permit the agitator to continue to operate, actuated by fluid pumped into the bore after the cement slurry, and which fluid is not directed into the annulus; the continued agitation of the string 10 may be useful in achieving a better quality cement seal.

In other embodiments the shock sub 16 may be omitted, the variation in the drilling fluid and cement slurry flow rate through the agitator, and the resulting pressure pulses, being sufficient to provide the desired degree of movement of the string 10.

The above-described embodiment is utilised in facilitating running in and cementing the last section of bore-lining tubing; the apparatus 12 remains in the bore 14 with the cemented string 10, and would prevent the bore being drilled beyond the end of the string 10. Thus, as the apparatus is only a "single-use" apparatus, and may therefore be constructed perhaps somewhat less robustly than conventional downhole apparatus intended for multiple uses. In other embodiments the apparatus 12 may be retrievable, for example by mounting the apparatus on an inner string within the liner string 10, such that the apparatus 12 may be pulled out of the cemented liner 10. This arrangement is also useful if the bore-lining tubing does not have a solid, fluid-tight wall, for example when embodiments of the invention are utilised in combination with slotted liner. Alternatively, the apparatus 12 may be drillable.

That which is claimed:

1. A method of running a bore-lining tubing string into a bore, the method comprising:

drilling a bore using a drill string;

running a bore-lining tubing string into the pre-drilled bore while producing pressure pulses directly in a fluid pumped through a throughbore of the bore-lining tubing string with a valve positioned in fluid communication with the fluid in the bore-lining tubing string and then transmitting the pressure pulses from the valve axially through the fluid in the throughbore of the bore-lining tubing string to agitate the bore-lining tubing string, the valve including a first valve plate and a second valve late;

wherein said pressure pulses are produced by translating the first valve plate relative to the second valve plate in a plane that is perpendicular to a central axis of the bore-lining tubing string to vary a dimension of a fluid passage extending through the first valve plate and the second valve plate, wherein the first valve plate is driven by a rotor of a motor, and wherein the pressure pulses are produced whilst the bore-lining tubing string is being translated axially into the pre-drilled bore during the running of the bore-lining tubing string into the pre-drilled bore;

reducing the friction between the bore-lining tubing string and the pre-drilled bore wall using said agitation of the bore-lining tubing string, to facilitate the translation of the bore-lining tubing string into the pre-drilled bore to line the drilled bore with bore-lining tubing; and lining the bore with the bore-lining tubing that has been run in.

2. The method of claim 1, wherein the bore-lining tubing string is the last string of bore-lining tubing to be run into the pre-drilled bore.

3. The method of claim 1, wherein the agitation of the bore-lining tubing string at least reduces static friction between the bore-lining tubing string and the predrilled bore wall.

4. The method of claim 1, wherein the agitation of the bore-lining tubing string serves to at least reduce gellation of fluid in the pre-drilled bore.

5. The method of claim 1, wherein the agitation of the bore-lining tubing string serves to fluidise sediments lying on the low side of a deviated bore.

6. The method of claim 1, wherein the bore-lining tubing string is rotated as it is advanced into the pre-drilled bore.

7. The method of claim 1, wherein a cutting structure is provided at a leading end of the bore-lining tubing string.

8. The method of claim 1, wherein at least a leading end of the bore-lining tubing string is rotated by a downhole motor.

9. The method of claim 1, wherein the bore-lining tubing string is rotated from surface.

10. The method of claim 1, wherein in excess of 48 percent of the weight applied to the bore-lining tubing string is transferred to the leading end of the bore-lining tubing string.

11. The method of claim 1, wherein in excess of 70 percent of the weight applied to the bore-lining tubing string is transferred to the leading end of the tubing string.

12. The method of claim 1, wherein in excess of 53 percent of the weight applied to the bore-lining tubing string is transferred to the leading end of the bore-lining tubing string.

13. The method of claim 1, wherein the bore-lining tubing string is agitated by operation of one or more agitators in the bore-lining tubing string.

14. The method of claim 13, wherein the one or more agitators are actuated by a fluid pumped through the bore-lining tubing string.

15. The method of claim 14, wherein the fluid actuates a downhole positive displacement motor, whereby the speed of the motor, and thus the rate of agitation, is controlled by varying the fluid flow rate.

16. The method of claim 14, wherein the fluid is at least one of drilling fluid, cement slurry and treating fluid.

17. The method of claim 1, wherein the bore-lining tubing string is agitated by operation of an agitator towards a leading end of the bore-lining tubing string.

18. The method of claim 1, wherein the fluid passage includes a flow passage portion that remains open.

19. The method of claim 1, wherein the agitator provides positive pressure pulses in the fluid above the valve and negative pressure pulses in the fluid below the valve.

20. The method of claim 19, wherein the agitator provides the positive pressure pulses to a shock tool in the bore-lining tubing string to axially extend and contract the tool in response to the positive pressure pulses.

21. The method of claim 1, wherein the motor is a fluid driven positive displacement motor and wherein the first valve plate is driven by the rotor of the fluid driven positive displacement motor.

22. The method of claim 21, wherein the positive displacement motor is a Moineau principle motor, and wherein the rotor is of the Moineau principle motor and is directly coupled to the first valve plate and provides both rotational and transverse movement to the valve member.

23. The method of claim 1, further comprising cementing the bore-lining tubing string in the pre-drilled bore while agitating the bore-lining tubing string.

24. The method of claim 23, further comprising agitating the bore-lining tubing string after the annulus has been filled with cement.

25. The method of claim 1, further comprising cementing the bore-lining tubing string in the pre-drilled bore while applying pressure pulses to the cement as it flows into and through an annulus between the walls of the pre-drilled bore and the bore-lining tubing string.

26. The method of claim 25, further comprising applying negative pressure pulses to the cement.

27. The method of claim 1, further comprising varying the agitation frequency of the bore-lining tubing string between at least two predetermined agitation frequencies.

28. The method of claim 1, further comprising varying the amplitude of the pressure pulses between at least two predetermined amplitudes.

29. The method of claim 1, wherein the valve utilized to agitate the bore-lining tubing string is left in the pre-drilled bore following cementation of the tubing string in the pre-drilled bore.

30. The method of claim 29, further comprising drilling through the valve and drilling the pre-drilled bore beyond the end of the bore-lining tubing string.

31. The method of claim 29, wherein the valve is at least part soluble and the method further comprises passing an appropriate material into the pre-drilled bore to at least weaken the valve and then removing the valve from the pre-drilled bore.

32. The method of claim 1, wherein the valve utilized to agitate the bore-lining tubing string is retrieved from the pre-drilled bore.

33. The method of claim 1, wherein the pressure pulses are produced continuously whilst running the bore-lining tubing string into the pre-drilled bore.

34. The method of claim 1, wherein the method comprises avoiding a natural frequency of bore-lining tubing string.

35. A method of flowing cement into a predrilled bore, the method comprising:

pumping cement through a tubular string;

translating a first valve plate relative to a second valve plate in a plane that is perpendicular to a central axis of the tubular string to vary a dimension of a fluid passage extending through the first valve plate and the second valve plate;

applying pressure pulses to the cement during the translating of the first valve plate relative to the second valve plate.

36. The method of claim 35, wherein the method comprises pumping cement through a throughbore into the annulus surrounding the tubular string while applying pressure pulses to the cement, and wherein said pressure pulses are produced by varying the dimension of the fluid passage extending through the first valve plate and the second valve plate, wherein each of the first valve plate and the second valve plate are positioned in the throughbore of the tubular string.

37. The method of claim 35, further comprising:

flowing cement between a rotor and a stator of a downhole positive displacement motor;

translating the rotor relative to the stator during the flowing of cement between the rotor and the stator; and flowing the cement through the fluid passage extending through the first valve plate and the second valve plate after flowing the cement between the rotor and the stator, wherein the first valve plate is mounted to the rotor of the downhole positive displacement motor.

38. The method of claim 37, further comprising:

rotating the rotor relative to the stator; and rotating the first valve plate relative to the second valve plate.

39. The method of claim 35, wherein the first valve plate includes a first flow port and the second valve plate includes a second flow port;

wherein the fluid passage is at least partially defined by the first flow port and the second flow port; and wherein translating the first valve plate relative to the second valve plate comprises translating the first flow port relative to the second flow port in a plane that is perpendicular to a central axis of the tubular string.

40. The method of claim 39, wherein translating the first valve plate relative to the second valve plate comprises constantly maintaining at least partial alignment between the first flow port and the second flow port.

* * * * *